US008287067B2

(12) United States Patent
Yamashita

(10) Patent No.: US 8,287,067 B2
(45) Date of Patent: Oct. 16, 2012

(54) RECORDING APPARATUS

(75) Inventor: Toru Yamashita, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 295 days.

(21) Appl. No.: 12/728,638

(22) Filed: Mar. 22, 2010

(65) Prior Publication Data

US 2010/0245417 A1 Sep. 30, 2010

(30) Foreign Application Priority Data

Mar. 27, 2009 (JP) ..... 2009-078028

(51) Int. Cl.
*B41J 29/38* (2006.01)

(52) U.S. Cl. ..... 347/9; 347/5

(58) Field of Classification Search ..... 347/5, 9–12, 347/15

See application file for complete search history.

(56) References Cited

U.S. PATENT DOCUMENTS 7,438,372 B2 * 10/2008 Imai ..... 347/10
2005/0110814 A1 5/2005 Imai

FOREIGN PATENT DOCUMENTS

JP 2005-153288 6/2005

* cited by examiner

*Primary Examiner* — Geoffrey Mruk
(74) *Attorney, Agent, or Firm* — Frommer Lawrence & Haug LLP

(57) ABSTRACT

A recording apparatus includes a recording head which has a plurality of recording elements, a drive unit, a selection-data generating mechanism which generates data for selecting a certain operation mode of the recording elements, a data transmitting mechanism which outputs a predetermined particular bit patterns at a tail end of the selection data, and a control-signal generating mechanism which generates a control signal for controlling the drive unit. The data transmitting mechanism inserts dummy data between the selection data.

8 Claims, 16 Drawing Sheets

NON-JETTING

EXTREMELY SMALL DROPLETS

SMALL DROPLETS 1

MEDIUM DROPLETS 1

LARGE DROPLETS 1

SMALL DROPLETS 2

MEDIUM DROPLETS 2

LARGE DROPLETS 2

Fig. 8

| OPERATING MODE | SELECTION DATA | | |
|---|---|---|---|
| | THIRD BIT | SECOND BIT | FIRST BIT |
| NON-JETTING | 0 | 0 | 0 |
| EXTREMELY SMALL DROPLETS | 0 | 0 | 1 |
| SMALL DROPLETS 1 | 0 | 1 | 0 |
| MEDIUM DROPLETS 1 | 0 | 1 | 1 |
| LARGE DROPLETS 1 | 1 | 0 | 0 |
| SMALL DROPLETS 2 | 1 | 0 | 1 |
| MEDIUM DROPLETS 2 | 1 | 1 | 0 |
| LARGE DROPLETS 2 | 1 | 1 | 1 |

Fig. 9A

| CLK NO. (TRANSFER ORDER) | SIN_0 | | SIN_1 | | SIN_2 | |
|---|---|---|---|---|---|---|
| | (OUTx) | n | (OUTx) | n | (OUTx) | n |
| 1 ↑ | 125 | 2 | 251 | 2 | 331 | 2 |
| 2 ↑ | | 1 | | 1 | | 1 |
| 3 ↑ | | 0 | | 0 | | 0 |
| 4 ↑ | 124 | 2 | 250 | 2 | 330 | 2 |
| 5 ↑ | | 1 | | 1 | | 1 |
| 6 ↑ | | 0 | | 0 | | 0 |
| 7 ↑ | 123 | 2 | 249 | 2 | (Dummy) | 2 |
| 8 ↑ | | 1 | | 1 | | 1 |
| 9 ↑ | | 0 | | 0 | | 0 |
| 10 ↑ | 122 | 2 | 248 | 2 | 329 | 2 |
| 11 ↑ | | 1 | | 1 | | 1 |
| 12 ↑ | | 0 | | 0 | | 0 |
| 13 ↑ | 121 | 2 | 247 | 2 | 328 | 2 |
| 14 ↑ | | 1 | | 1 | | 1 |
| 15 ↑ | | 0 | | 0 | | 0 |
| 16 ↑ | 120 | 2 | 246 | 2 | (Dummy) | 2 |
| 17 ↑ | | 1 | | 1 | | 1 |
| 18 ↑ | | 0 | | 0 | | 0 |
| ⋮ | ⋮ | ⋮ | ⋮ | ⋮ | ⋮ | ⋮ |

Fig. 9B

| CLK NO. (TRANSFER ORDER) | SIN_0 | | SIN_1 | | SIN_2 | |
|---|---|---|---|---|---|---|
| | (OUTx) | n | (OUTx) | n | (OUTx) | n |
| ⋮ | ⋮ | ⋮ | ⋮ | ⋮ | ⋮ | ⋮ |
| 355 ↑ | 7 | 2 | 133 | 2 | 252 | 2 |
| 356 ↑ | | 1 | | 1 | | 1 |
| 357 ↑ | | 0 | | 0 | | 0 |
| 358 ↑ | 6 | 2 | 132 | 2 | Low | 2 |
| 359 ↑ | | 1 | | 1 | Low | 1 |
| 360 ↑ | | 0 | | 0 | Low | 0 |
| 361 ↑ | 5 | 2 | 131 | 2 | Low | 2 |
| 362 ↑ | | 1 | | 1 | Low | 1 |
| 363 ↑ | | 0 | | 0 | Low | 0 |
| 364 ↑ | 4 | 2 | 130 | 2 | Low | 2 |
| 365 ↑ | | 1 | | 1 | Low | 1 |
| 366 ↑ | | 0 | | 0 | Low | 0 |
| 367 ↑ | 3 | 2 | 129 | 2 | Low | 2 |
| 368 ↑ | | 1 | | 1 | Low | 1 |
| 369 ↑ | | 0 | | 0 | Low | 0 |
| 370 ↑ | 2 | 2 | 128 | 2 | Low | 2 |
| 371 ↑ | | 1 | | 1 | Low | 1 |
| 372 ↑ | | 0 | | 0 | Hi | 0 |
| 373 ↑ | 1 | 2 | 127 | 2 | Hi | 2 |
| 374 ↑ | | 1 | | 1 | Hi | 1 |
| 375 ↑ | | 0 | | 0 | Hi | 0 |
| 376 ↑ | 0 | 2 | 126 | 2 | Hi | 2 |
| 377 ↑ | | 1 | | 1 | Hi | 1 |
| 378 ↑ | | 0 | | 0 | Hi | 0 |

Fig. 11A

| CLK NO. (TRANSFER ORDER) | SIN_2 | |
|---|---|---|
| | (OUTx) | n |
| 1 ↑ | 1 | 2 |
| 2 ↑ | | 1 |
| 3 ↑ | | 0 |
| 4 ↑ | 0 | 2 |
| 5 ↑ | | 1 |
| 6 ↑ | | 0 |
| 7 ↑ | Hi | 2 |
| 8 ↑ | | 1 |
| 9 ↑ | | 0 |
| 10 ↑ | Hi | 2 |
| 11 ↑ | Hi | 1 |
| 12 ↑ | Hi | 0 |
| 13 ↑ | Hi | 2 |
| 14 ↑ | Hi | 1 |
| 15 ↑ | Hi | 0 |

Fig. 11B

| CLK NO. (TRANSFER ORDER) | SIN_2 | |
|---|---|---|
| | (OUTx) | n |
| 1 ↑ | 1 | 3 |
| 2 ↑ | | 2 |
| 3 ↑ | | 1 |
| 4 ↑ | | 0 |
| 5 ↑ | 0 | 3 |
| 6 ↑ | | 2 |
| 7 ↑ | | 1 |
| 8 ↑ | | 0 |
| 9 ↑ | Hi | 3 |
| 10 ↑ | Hi | 2 |
| 11 ↑ | Hi | 1 |
| 12 ↑ | Hi | 0 |

Fig. 12A

| CLK NO. (TRANSFER ORDER) | SIN_0 | | SIN_2 | |
|---|---|---|---|---|
| | (OUTx) | n | (OUTx) | n |
| 1 ↑ | 4 | 2 | 6 | 2 |
| 2 ↑ | | 1 | | 1 |
| 3 ↑ | | 0 | | 0 |
| 4 ↑ | 3 | 2 | 5 | 2 |
| 5 ↑ | | 1 | | 1 |
| 6 ↑ | | 0 | | 0 |
| 7 ↑ | 2 | 2 | Hi | 2 |
| 8 ↑ | | 1 | | 1 |
| 9 ↑ | | 0 | | 0 |
| 10 ↑ | 1 | 2 | Hi | 2 |
| 11 ↑ | | 1 | Hi | 1 |
| 12 ↑ | | 0 | Hi | 0 |
| 13 ↑ | 0 | 2 | Hi | 2 |
| 14 ↑ | | 1 | Hi | 1 |
| 15 ↑ | | 0 | Hi | 0 |

Fig. 12B

| CLK NO. (TRANSFER ORDER) | SIN_0 | | SIN_2 | |
|---|---|---|---|---|
| | (OUTx) | n | (OUTx) | n |
| 1 ↑ | 3 | 3 | 6 | 3 |
| 2 ↑ | | 2 | | 2 |
| 3 ↑ | | 1 | | 1 |
| 4 ↑ | | 0 | | 0 |
| 5 ↑ | 2 | 3 | 5 | 3 |
| 6 ↑ | | 2 | | 2 |
| 7 ↑ | | 1 | | 1 |
| 8 ↑ | | 0 | | 0 |
| 9 ↑ | 1 | 3 | 4 | 3 |
| 10 ↑ | | 2 | | 2 |
| 11 ↑ | | 1 | | 1 |
| 12 ↑ | | 0 | | 0 |
| 13 ↑ | 0 | 3 | Hi | 3 |
| 14 ↑ | | 2 | Hi | 2 |
| 15 ↑ | | 1 | Hi | 1 |
| 16 ↑ | | 0 | Hi | 0 |

Fig. 13A

| CLK NO. (TRANSFER ORDER) | SIN_0 | | SIN_2 | |
|---|---|---|---|---|
| | (OUTx) | n | (OUTx) | n |
| 1 ↑ | 7 | 2 | 11 | 2 |
| 2 ↑ | | 1 | | 1 |
| 3 ↑ | | 0 | | 0 |
| 4 ↑ | 6 | 2 | 10 | 2 |
| 5 ↑ | | 1 | | 1 |
| 6 ↑ | | 0 | | 0 |
| 7 ↑ | 5 | 2 | (Dummy) | 2 |
| 8 ↑ | | 1 | | 1 |
| 9 ↑ | | 0 | | 0 |
| 10 ↑ | 4 | 2 | 9 | 2 |
| 11 ↑ | | 1 | | 1 |
| 12 ↑ | | 0 | | 0 |
| 13 ↑ | 3 | 2 | 8 | 2 |
| 14 ↑ | | 1 | | 1 |
| 15 ↑ | | 0 | | 0 |
| 16 ↑ | 2 | 2 | | 2 |
| 17 ↑ | | 1 | | 1 |
| 18 ↑ | | 0 | Hi | 0 |
| 19 ↑ | 1 | 2 | Hi | 2 |
| 20 ↑ | | 1 | Hi | 1 |
| 21 ↑ | | 0 | Hi | 0 |
| 22 ↑ | 0 | 2 | Hi | 2 |
| 23 ↑ | | 1 | Hi | 1 |
| 24 ↑ | | 0 | Hi | 0 |

Fig. 13B

| CLK NO. (TRANSFER ORDER) | SIN_0 | | SIN_2 | |
|---|---|---|---|---|
| | (OUTx) | n | (OUTx) | n |
| 1 ↑ | 6 | 3 | 11 | 3 |
| 2 ↑ | | 2 | | 2 |
| 3 ↑ | | 1 | | 1 |
| 4 ↑ | | 0 | | 0 |
| 5 ↑ | 5 | 3 | 10 | 3 |
| 6 ↑ | | 2 | | 2 |
| 7 ↑ | | 1 | | 1 |
| 8 ↑ | | 0 | | 0 |
| 9 ↑ | 4 | 3 | 9 | 3 |
| 10 ↑ | | 2 | | 2 |
| 11 ↑ | | 1 | | 1 |
| 12 ↑ | | 0 | | 0 |
| 13 ↑ | 3 | 3 | 8 | 3 |
| 14 ↑ | | 2 | | 2 |
| 15 ↑ | | 1 | | 1 |
| 16 ↑ | | 0 | | 0 |
| 17 ↑ | 2 | 3 | 7 | 3 |
| 18 ↑ | | 2 | | 2 |
| 19 ↑ | | 1 | | 1 |
| 20 ↑ | | 0 | | 0 |
| 21 ↑ | 1 | 3 | | 3 |
| 22 ↑ | | 2 | | 2 |
| 23 ↑ | | 1 | | 1 |
| 24 ↑ | | 0 | | 0 |
| 25 ↑ | 0 | 3 | Hi | 3 |
| 26 ↑ | | 2 | Hi | 2 |
| 27 ↑ | | 1 | Hi | 1 |
| 28 ↑ | | 0 | Hi | 0 |

RECORDING APPARATUS

CROSS REFERENCE TO RELATED APPLICATION

The present application claims priority from Japanese Patent Application No. 2009-078028 filed on Mar. 27, 2009, the disclosures of which are incorporated herein by reference in their entirety.

BACKGROUND OF THE INVENTION

1. Field of the Invention

The present invention relates to a recording apparatus which carries out recording on a recording medium.

2. Description of the Related Art

A recording apparatus which carries out recording on a recording paper, in general, includes a plurality of recording elements, and a drive unit which drives the plurality of recording elements based on a signal from a control circuit. For instance, an ink-jet head which carries out printing on a recording medium by jetting an ink from a plurality of nozzles has hitherto been known. This ink-jet head includes a piezoelectric actuator which applies pressure for jetting ink from the plurality of nozzles, and a driver IC (drive unit) which supplies a drive signal to a plurality of individual electrodes, of the piezoelectric actuator, corresponding to the plurality of nozzles respectively.

In a certain recording apparatus, seven types of waveform signals corresponding to seven available operation modes (including a non jetting mode in which no liquid droplets are jetted), and selection data (printing data signal) each consisting of three-bit data are input to the driver IC from a control circuit board of a printer. The selection data indicates information as to which waveform signal is to be associated for each of the nozzles. The three-bit data of each of the selection data is input serially from the control circuit to the driver IC.

The driver IC includes a shift register (a serial-parallel converter), a D flip-flop (a latching circuit), a multiplexer (a waveform selector circuit), and a drive buffer. The shift register converts a plurality of selection data which has been input serially from the control circuit corresponding to the plurality of nozzles, into parallel data, and outputs to the D flip-flop. The D flip-flop holds the plurality of selection data which has been input in parallel from the shift register until a strobe signal which indicates completion of input of a block of the selection data corresponding to all the nozzles. When the strobe signal is input, the D flip-flop outputs the block of the selection data which is held in the D flip-flop to the multiplexer in parallel. The multiplexer selects one of the waveform signals among the seven types of waveform signals based on the selection data for each of the nozzles. The drive buffer generates a drive signal by amplifying the waveform signal which has been output from the multiplexer, and outputs the drive signal to the piezoelectric actuator.

Here, eight combinations (eight bit-patterns) are possible for three-bit data forming the selection data. Out of these eight combinations, seven combinations are assigned to the abovementioned seven types of operation modes, whereas, the remaining one type (concretely, '111'), is used for a purpose other than selecting the operation mode (waveform signal) in the driver IC.

The strobe signal may be generated by the control circuit, and may be transferred to the D flip-flop in the driver IC when the transfer of all the selection data is completed. However, in the abovementioned recording apparatus, the driver IC includes a strobe-signal generating circuit which generates the strobe signal and outputs the strobe signal to the D flip-flop.

In the abovementioned recording apparatus, out of the three-bit combinations which are input serially from the control circuit to the driver IC, one type of combination ('111') is not used for the selection data selecting the operation mode (waveform signal). Therefore, even though bit data '1' is transferred continuously for three times or more, it is possible to distinguish certain data consisting of successive three times or more '1' bits from the seven types of the selection data corresponding to the seven types the waveform signals. Therefore, in the abovementioned recording apparatus, the control circuit is configured such that, bit '1' is transferred continuously for five times at an end of the plurality of selection data, and that when the strobe-signal generating circuit in the driver IC receive the data consisting of the five successive "1" bits, the strobe-signal generating circuit judges that the input of the selection data corresponding to all the nozzles is over, and generates the strobe signal to output to the D flip-flop. In this manner, since the strobe signal is generated in the driver IC, it is possible to omit a signal wire for transmitting the strobe signal from the control circuit to the driver IC.

SUMMARY OF THE INVENTION

Incidentally, in recent years, for improving the printing quality, variation in a size of liquid droplets to be jetted from the nozzles has been sought, and a need to increase the types of operation modes has been growing. Here, it is necessary to increase the types of selection data (combinations of the bit data) corresponding to the operation modes in order to increase the types of the operation modes. However, when the number of bits of the selection data is increased for this purpose, it is necessary to a circuit which is capable of processing larger number of data. Therefore, a cost of the driver IC would increase substantially. Moreover, the time for a serial transfer of the selection data to the driver IC would become long.

Therefore, in the abovementioned recording apparatus, it is taken into consideration that the combination ('111') of the bit data, which had been assigned exclusively for generating a signal such as the strobe signal, is assigned to the selection data for selecting the operation mode. However, in a circuit structure of the abovementioned recording apparatus, when data of bit '1' is input continuously from the control circuit to the driver IC, it is not possible for the driver IC to distinguish whether the data input is selection data for selecting the operation mode or trigger data for generating the strobe signal etc.

An object of the present invention is to provide a recording apparatus in which, it is possible to use the combination of bit data which conventionally has been assigned (allocated) for generating a control signal even in the selection data for selecting the operation mode, and to increase the types of operation mode without increasing the number of bits of the selection data.

A recording apparatus according to a first aspect of the present invention includes:

a recording head having a plurality of recording elements each of which operates in a plurality of operation modes;

a drive unit which drives the recording elements;

a selection-data generating mechanism which generates a plurality of types of selection data, each of the selection data including a plurality of bit data, and being associated with one of the recording elements for selecting an operation mode, among the operation modes, of the one of the recording elements;

a data transmitting mechanism which outputs serially the selection data generated in the selection-data generating mechanism to the drive unit, and also outputs certain bit data which forms one type of the selection data at a tail end of the serially outputted selection data to the drive unit, the certain bit data including a predetermined number of bits larger than the number of bits of the selection data; and a control-signal generating mechanism which generates a control signal which controls the drive unit, under a condition that the bit data having the predetermined number of bits is inputted to the drive unit from the data transmitting mechanism. The data transmitting mechanism inserts insertion data which is different from the one type of the selection data between the selection data associated with the recording elements, and outputs the selection data and the insertion data to the drive unit.

In the present invention, the data transmitting mechanism transmits the bit data (bit data for which combination with the selection data of one type is same) which forms the selection data of a certain type as a predetermined number of bits larger than the number of bits of the selection data, after outputting serially to the drive unit, selection data for selecting the operation mode for each of the plurality of recording elements, at the tail end thereof. Next, the control signal generating mechanism of the drive unit generates a control signal for controlling the drive unit, from the bit data which has been transmitted continuously. In this manner, since the control signal for controlling the drive unit is generated in the drive unit, a signal wire for inputting the control signal to the drive unit from an external circuit is not necessary.

As it has been mentioned above, since a combination of bit data same as the selection data of one type inputted from the data transmitting mechanism is used for generating the control signal, it is necessary that the drive unit is capable of distinguishing whether the data transmitted by the data transmitting mechanism is selection data for selecting the operation mode or data for generating the control signal. In the present invention, the data transmitting mechanism inserts the insertion data for which a combination of the bit data is different from the one type of selection data between the selection data, at the time of outputting serially, the selection data associated with the recording elements to the drive unit. Accordingly, even in a case in which the one type of the selection data would have been sent continuously, the insertion data is inserted between the selection data at the time of transmitting to the drive unit practically. Therefore, it is possible to prevent from being distinguished mistakenly as data for generating the control signal.

Consequently, it is possible to use a combination of bit data of one type for both the selection data for selecting the operation mode and the data for generating the control signal. In other words, since it is possible to use the bit data, allocated exclusively for generating the control signal conventionally, as the selection data, it is possible to increase the types of the operation mode without increasing the number of bits of the selection data.

According to the present invention, since the control signal for controlling the drive unit is generated at the interior of the drive unit, a signal wire for inputting the control signal to the drive unit from an external circuit is not necessary. Furthermore, since it is possible to increase the types of operation modes without increasing the number of bits of the selection data, a circuit structure of the drive unit does not become complicated, and also a transfer time does not become that long.

BRIEF DESCRIPTION OF THE DRAWINGS

FIG. 6A shows a non-jetting mode, FIG. 6B shows a first jetting mode of jetting extremely small droplets, FIG. 6C shows a first jetting mode of jetting small droplets, FIG. 6D shows a first jetting mode of jetting medium droplets, FIG. 6E shows a first jetting mode of jetting large droplets, FIG. 6F shows a second jetting mode of jetting small droplets, FIG. 6G shows a second jetting mode of jetting medium droplets, and FIG. 6H shows a second jetting mode of jetting large droplets;

FIG. 8 is a diagram showing a relationship of the operation modes and selection data of three bits;

FIGS. 9A and 9B show an order of transfer of the selection data which is transferred in synchronization with a transfer clock;

FIGS. 11A and 11B are diagrams showing an order of transfer when the number of transfers of the selection data is two, where, FIG. 11A shows a case in which the selection data is three bits, and FIG. 11B shows a case in which the selection data is four bits;

FIGS. 12A and 12B are diagrams showing an order of transfer when the number of transfers of the selection data is seven, where, FIG. 12A shows a case in which the selection data is three bits, and FIG. 12B shows a case in which the selection data is four bits; and FIGS. 13A and 13B are diagrams showing an order of transfer when the number of transfers of the selection data is twelve, where, FIG. 13A shows a case in which the selection data is three bits, and FIG. 13B shows a case in which the selection data is four bits.

DETAILED DESCRIPTION OF THE PREFERRED EMBODIMENTS

Next, an embodiment of the present teachings will be described below. The embodiment is an example in which the present teachings are applied to an ink-jet printer including an ink-jet head which jets droplets of an ink on to a recording paper.

Figure 1:
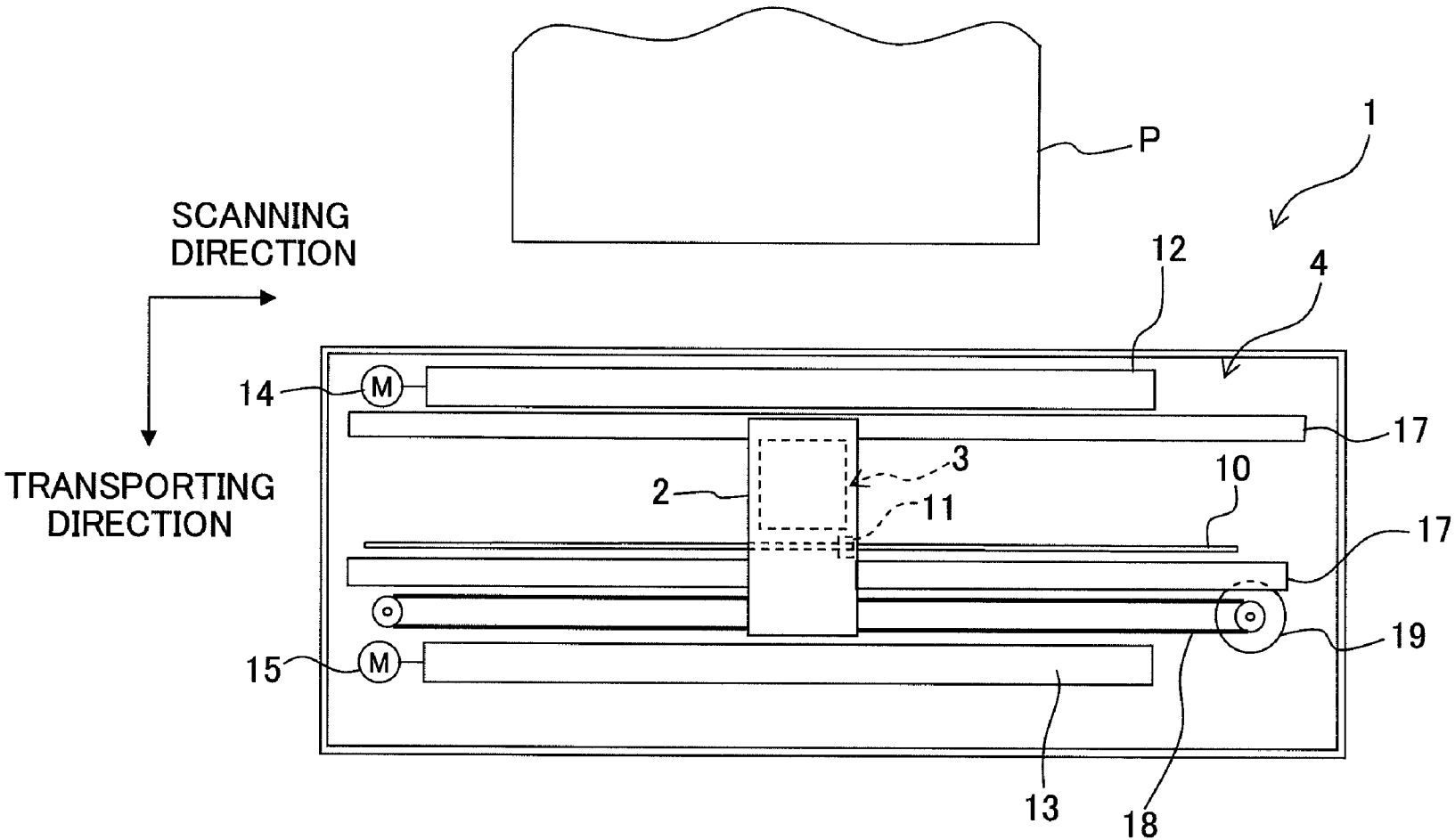
FIG. 1 is a schematic plan view of a printer according to an embodiment.

Firstly, a schematic structure of an ink-jet printer 1 (hereinafter, 'printer 1') (a recording apparatus) of the embodiment will be described below. As shown in FIG. 1, the ink jet printer 1 includes a carriage 2 which is reciprocatable in a predetermined scanning direction (left-right direction in FIG. 1), an ink jet head 3 (a recording head) which is mounted on the carriage 2, and a transporting mechanism 4 which transports a recording paper P in a transporting direction of which is orthogonal to the scanning direction.

The carriage 2 reciprocates along two guide shafts 17 extending parallel to the scanning direction (left-right direction in FIG. 1). Moreover, an endless belt 18 is coupled with the carriage 2, and when the endless belt 18 is driven to run by a carriage driving motor 19, the carriage 2 moves in the scanning direction together with the running of the endless belt 18. The printer 1 is provided with a linear encoder 10, which has a multiple number of light transmission portions (slits) arranged in a row at an interval in the scanning direction. Whereas, the carriage 2 is provided with a photo sensor 11 of a transmission type, which has a light emitting element and a light receiving element. Moreover, in the printer 1, it is possible to identify a current position of the carriage 2 in the scanning direction based on the number of the light transmission portion of the linear encoder 10 (detection counts), which has been detected by the photo sensor 11 during the movement of the carriage 2.

The ink jet head 3 is mounted on the carriage 2. A plurality of nozzles 30 (refer to FIGS. 2, 3, and 4) is formed in a lower surface (a surface on the other side of a paper plane in FIG. 1) of the ink-jet head 3. The ink jet head 3 is structured such that, an ink supplied from an ink cartridge is jetted from the plurality of nozzles 30 onto the recording paper P which is transported in the transporting direction as shown in FIG. 1 by the transporting mechanism 4.

The transporting mechanism 4 includes a paper feeding roller 12 which is arranged at an upstream side of the ink-jet head 3 in the transporting direction, and a paper discharge roller 13 which is arranged at a downstream side of the ink jet head 3 in the transporting direction. The paper feeding roller 12 and the paper discharge roller 13 are driven by a paper feeding motor 14 and a paper discharge motor 15, respectively. Moreover, the transporting mechanism 4 transports the recording paper P from an upstream side in the transporting direction to the ink-jet head 3 by the paper feeding roller 12, and discharges the recording paper P, on which the ink-jet head 3 records images, characters or the like, to the downstream side in the transporting direction by the paper discharge roller 13.

Figure 2:
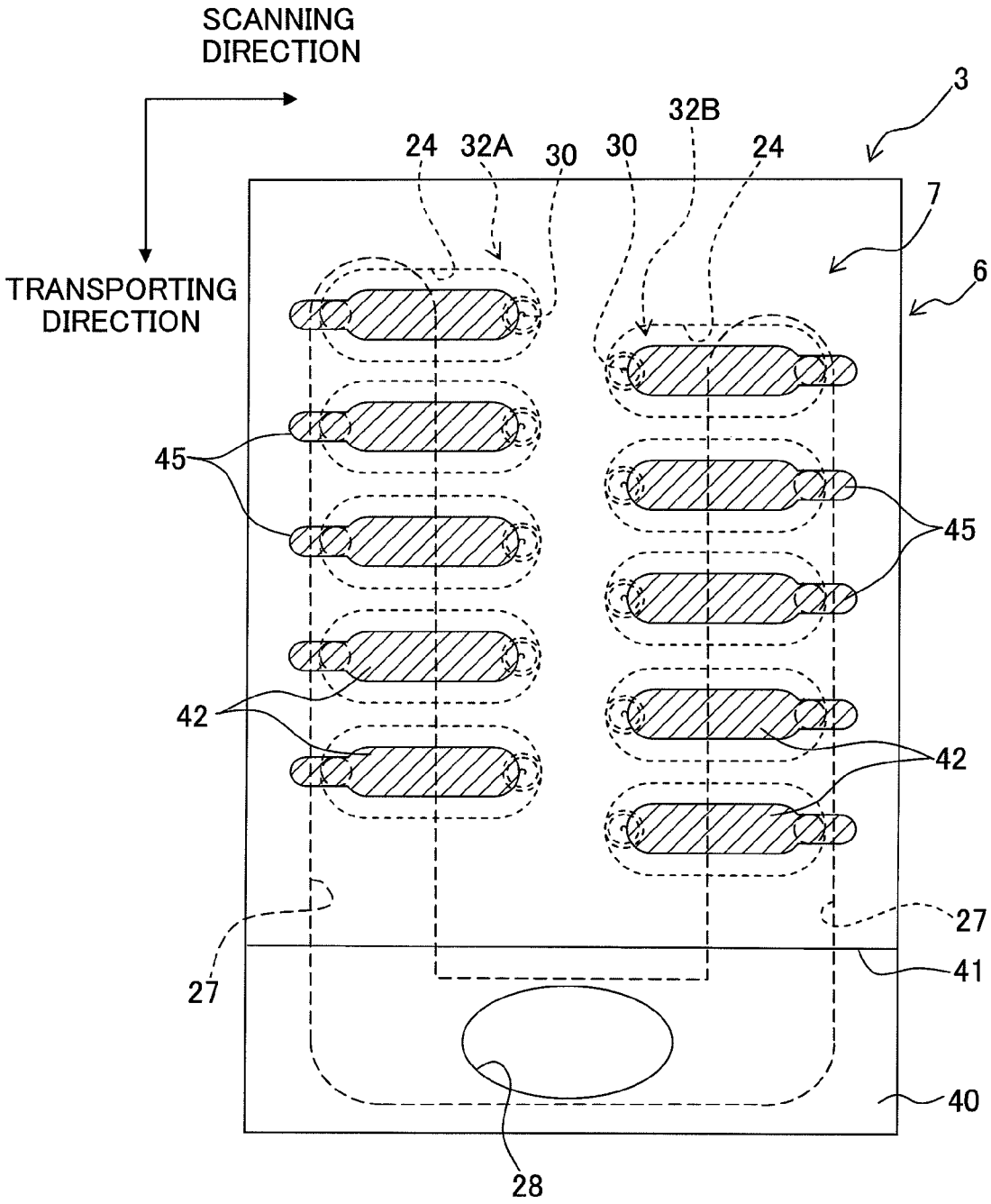
FIG. 2 is a plan view of an ink-jet head.
Figure 3:
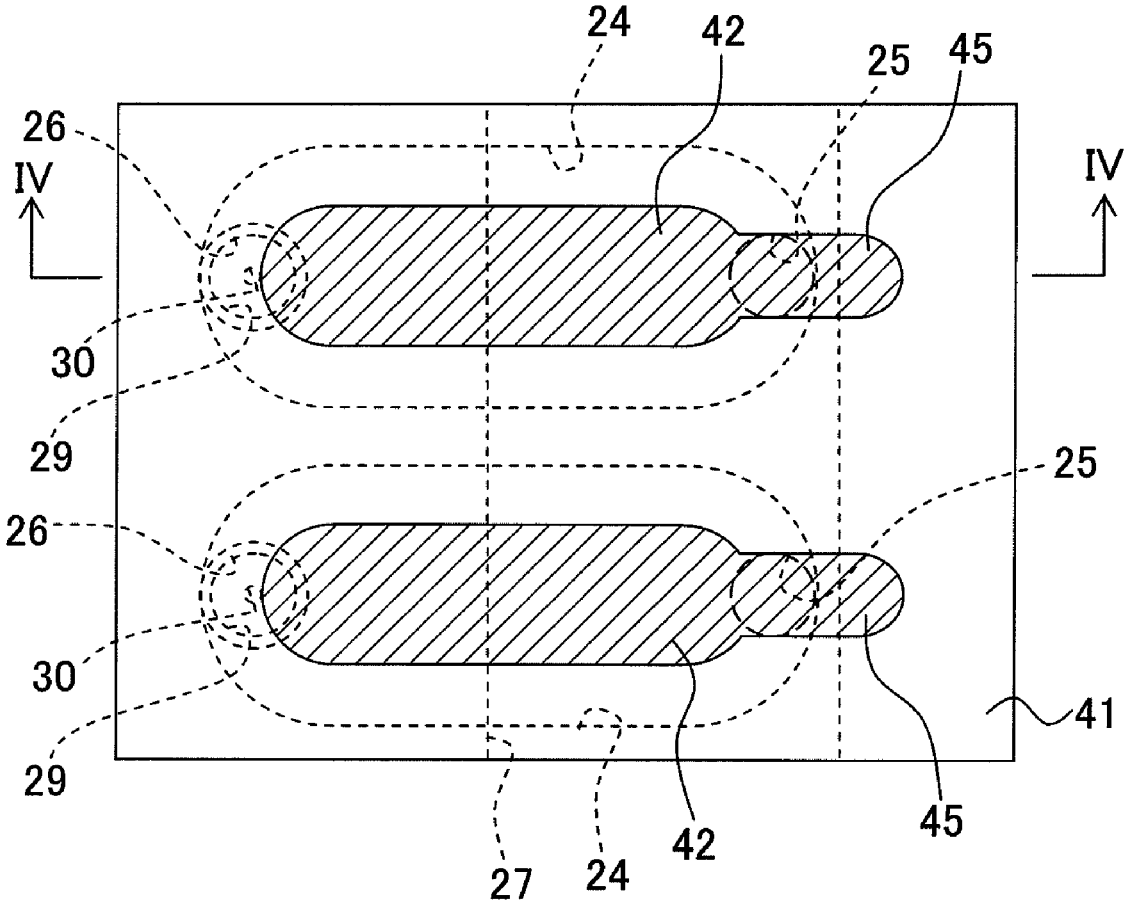
FIG. 3 is a partially enlarged view of FIG. 2.
Figure 4:
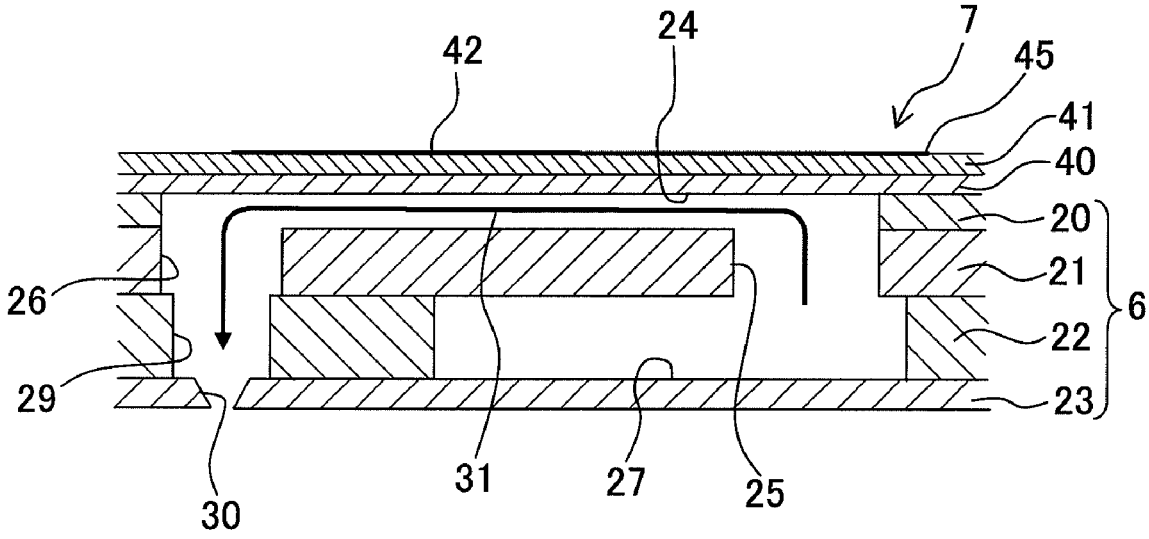
FIG. 4 is a cross-sectional view taken along a line IV-IV in FIG. 3.

Next, the ink-jet head 3 will be described below. As shown in FIGS. 2 to 4, the ink-jet head 3 includes a channel unit 6 in which ink channels including the nozzles 30 and pressure chambers 24 are formed, and an actuator unit 7 of a piezoelectric type which applies pressure to ink in the pressure chambers 24.

Firstly, the channel unit 6 will be described below. As shown in FIG. 4, the channel unit 6 includes a cavity plate 20, a base plate 21, a manifold plate 22, and a nozzle plate 23, and these four plates 20 to 23 are stacked and joined. The cavity plate 20, the base plate 21, and the manifold plate 22 have a substantially rectangular shape in a plan view, and are formed of a metallic material such as stainless steel. Therefore, it is possible to form channels such as a manifold 27 and the pressure chamber 24, which will be described later, easily in these three plates 20 to 22 by etching. Moreover, the nozzle plate 23 is formed of a high-molecular synthetic resin material such as polyimide, and is joined to a lower surface of the manifold plate 22 by an adhesive. Alternatively, the nozzle plate 23 may also be formed of a metallic material such as stainless steel, similarly as the other three plates 20 to 22.

As shown in FIGS. 2 to 4, a plurality of holes cut through the cavity plate 20 is formed in the cavity plate 20 which is at an uppermost layer in the four plates 20 to 23, and accordingly, the plurality of pressure chambers 24 arranged in a row in a planar direction parallel to the surface of the cavity plate 20 is formed in the cavity plate 20. As shown in FIG. 2, the pressure chambers 24 are arranged in two rows in a staggered manner in the transporting direction. Moreover, as shown in FIG. 4, the pressure chambers 24 are covered by the base plate 21 and a vibration plate 40 which will be described later, from upper and lower sides. Each of the pressure chambers 24 is formed to have a substantially elliptical shape of which longer axis (longitudinal axis) is parallel to the scanning direction (see FIG. 2). In other words, a longitudinal direction of each of the pressure chambers 24 coincides with the scanning direction.

As shown in FIGS. 3 and 4, communicating holes 25 and 26 are formed in the base plate 21, at positions overlapping with two end portions, of the pressure chamber 24, in the longitudinal direction in a plan view. Moreover, the two manifolds 27 extended in the transporting direction are formed in the manifold plate 22. As shown in FIG. 2, the two manifolds 27 overlap with two arrays of the pressure chambers 24 so that the manifolds 27 overlaps with one end portions of the pressure chambers 24 on the communicating holes 25 side, in a plan view. These two manifolds 27 communicate with an ink supply port 28 formed in the vibration plate 40 which will be described later, and ink is supplied from an ink tank not shown in the diagram, to the manifold 27 via the ink supply port 28. Furthermore, a plurality of communicating holes 29 communicating with the plurality of communicating holes 26 is formed in the manifold plate 22, at positions overlapping with opposite end portions, of the pressure chambers 24, on an opposite side of the manifold 27, in a plan view.

Furthermore, the plurality of nozzles 30 is formed in the nozzle plate 23, at positions overlapping with the plurality of communicating holes 29 in a plan view. As shown in FIG. 2, the plurality of nozzles 30 is arranged to overlap with the opposite end portions of the pressure chambers 24 arranged in two rows along the transporting direction, on the opposite side of the manifold 27. In other words, the plurality of nozzles 30 is arranged in a staggered manner corresponding to the plurality of pressure chambers 24 arranged in a staggered manner, and the nozzles 30 are arranged to form two nozzle rows 32A and 32B arranged side-by-side in the scanning direction.

Moreover, as shown in FIG. 4, each of the manifolds 27 communicates with the pressure chambers 24 via the communicating holes 25, and furthermore, each of the pressure chambers 24 communicates with one of the nozzles 30 via one of the communicating holes 26 and 29. In this manner, a plurality of ink channels 31 each running from one of the manifolds 27 to one of the nozzles 30 via one of the pressure chambers 24 is formed in the channel unit 6.

In FIG. 2, for simplifying the description, only one group of interconnected channels (including the manifolds 27, the pressure chambers 24, and the nozzles 30) communicating with one ink supply port 28 is indicated. However, the present teachings are not restricted to the one group of interconnected channels. For instance, the ink-jet head 3 may have a plurality of groups of interconnected channels arranged side-by-side in the scanning direction, and furthermore, the ink-jet head 3 may be a color ink-jet head which has a plurality of groups of interconnected channels for jetting different color inks (for example, four colors namely, black, yellow, cyan, and magenta).

Next, the actuator unit 7 of the piezoelectric type will be described below. As shown in FIGS. 2, 3, and 4, the actuator unit 7 includes the vibration plate 40 which is arranged on an upper surface of the channel unit 6 (the cavity plate 20) to cover the plurality of pressure chambers 24, a piezoelectric layer 41 which is arranged on an upper surface of the vibration plate 40 to overlap with the plurality of pressure chambers 24, and a plurality of individual electrodes 42 which is arranged on an upper surface of the piezoelectric layer 41 corresponding to the pressure chambers.

The vibration plate 40 is a metallic plate having a substantially rectangular shape in a plan view, and is made of a material such as an iron alloy (for example stainless steel), a copper alloy, a nickel alloy, or a titanium alloy. The vibration plate 40 is joined to the upper surface of the cavity plate 20 so that the vibration plate 40 covers the plurality of pressure chambers 24. Moreover, an upper surface, of the vibration plate 40, which is electroconductive is arranged on a lower-surface side of the piezoelectric layer 41. Therefore, the upper surface of the vibration plate 40 is also capable of serving as a common electrode, and generates an electric field, in a thickness direction of the piezoelectric layer 41, in a portion of the piezoelectric layer 41 arranged between the plurality of individual electrodes 42 and the vibration plate 40. The vibration plate 40 as the common electrode is connected to a ground wire of a driver IC 47 (refer to FIG. 5) which drives the actuator unit 7, and is kept at a ground electric potential all the time.

The piezoelectric layer 41 is made of a piezoelectric material having lead zirconate titanate (PZT) as a main component, which is a solid solution of lead titanate and lead zirconate. As shown in FIG. 2, the piezoelectric layer 41 is formed on the upper surface of the vibration plate 40, continuously spread over the plurality of pressure chambers 24. Moreover, the piezoelectric layer 41 is polarized in the thickness direction at least in an area facing the pressure chambers 24.

The plurality of individual electrodes 42 is formed on the upper surface of the piezoelectric layer 41, in areas facing the plurality of pressure chambers 24. Each of the individual electrodes 42 has a substantially elliptical shape slightly smaller than the pressure chamber 24 in a plan view, and faces a central portion of the pressure chamber 24. Moreover, a plurality of contact portions 45 is drawn in a longitudinal direction of the individual electrode 42 from end portions of the plurality of individual electrodes 42.

Figure 5:
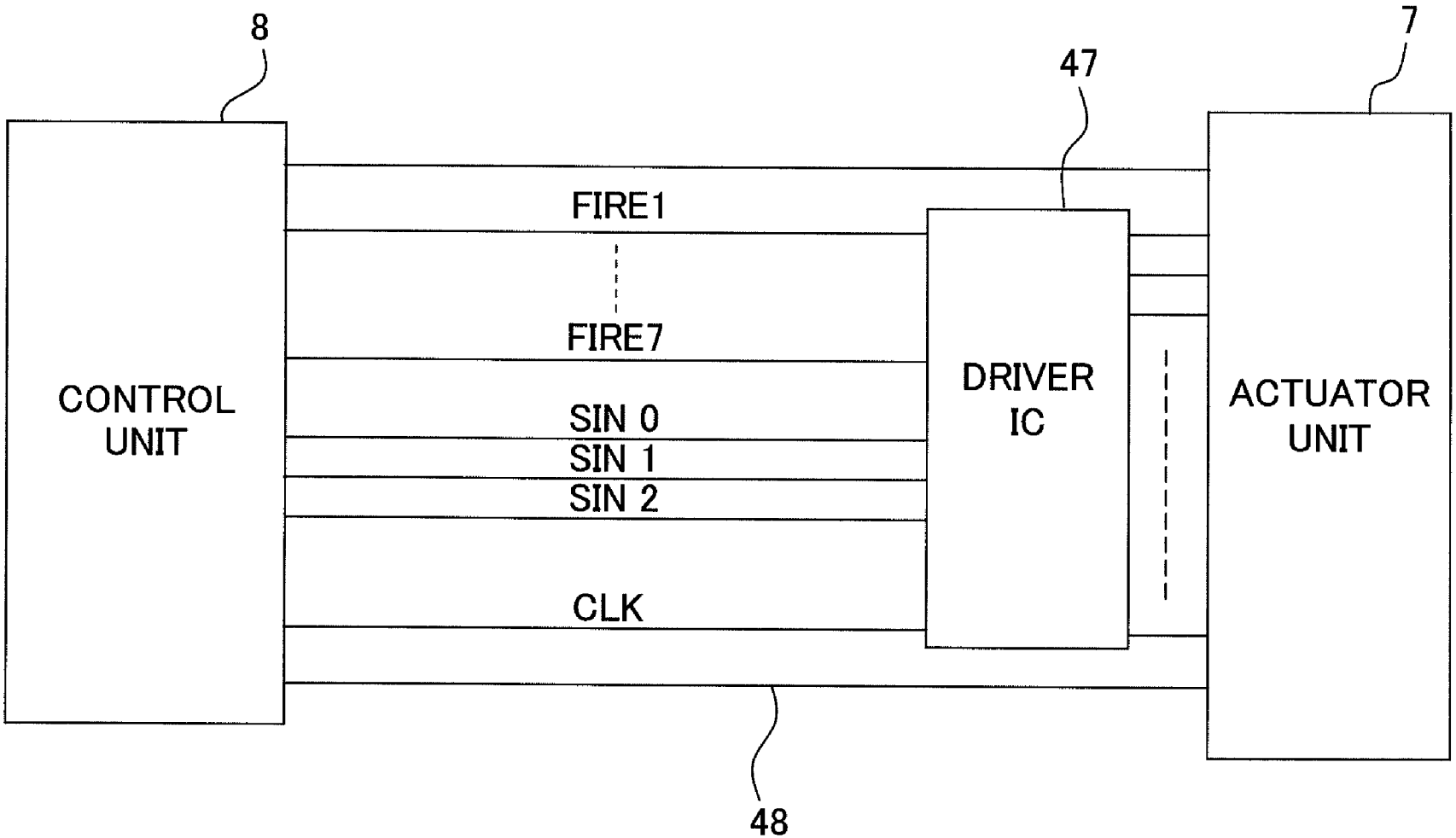
FIG. 5 is a diagram showing a structure of connections of an actuator unit, a driver IC, and a control unit.

As shown in FIG. 5, the plurality of contact portions 45 on the actuator unit 7 (the piezoelectric layer 41) is connected electrically to the driver IC 47 (a drive unit) which is mounted on a flexible printed circuit (FPC) 48. Moreover, the driver IC 47 applies a drive pulse signal to the plurality of individual electrodes 42 via wires on the FPC 48, based on a command from a control unit 8. Accordingly, driver IC 47 selectively applies one of a predetermined driving electric potential and the ground electric potential to the individual electrodes 42.

Next, an operation of the piezoelectric actuator 7 at the time of jetting ink will be described below. When the predetermined driving electric potential is applied to a certain individual electrode 42 from the driver IC 47, an electric potential difference is developed between the individual electrode 42 to which the driving electric potential is applied and the vibration plate 40 as a common electrode which is kept at the ground electric potential. Then, an electric field in a thickness direction of the piezoelectric layer 41 acts in the piezoelectric layer 41 sandwiched between the individual electrode 42 and the vibration plate 40. Since a direction of the electric field is parallel to a polarizing direction in which the piezoelectric layer 41 is polarized, the piezoelectric layer 41 in an area (an active area) facing the individual electrode 42 contracts in a planar direction which is orthogonal to the thickness direction. Here, the vibration plate 40 on the lower side of the piezoelectric layer 41 is fixed to the cavity plate 20. Therefore, a portion of the vibration plate 40 covering the pressure chamber 24 is deformed to form a projection toward the pressure chamber 24 (unimorph deformation), due to contraction of the piezoelectric layer 41 positioned on the upper surface of the vibration plate 40 in the planar direction. At this time, since a volume in the pressure chamber 24 decreases, pressure of ink in the pressure chamber 24 rises up and ink is jetted from the nozzle 30 communicating with this pressure chamber 24.

In this embodiment, a portion of the actuator unit 7 corresponds to one recording element according to the present teachings, wherein the actuator unit 7 includes the individual ink channels 31 (also called as channels) each having one nozzle 30 and one pressure chamber 24 communicating with the one nozzle 30, and the individual electrode 42 facing the pressure chambers 24, and the actuator unit 7 applies pressure to ink in the pressure chamber 24.

The ink-jet head 3 of the embodiment records (prints) desired characters and/or images by forming dots at predetermined positions on the recording paper P by selecting whether to jet droplets of ink (jetting mode) or not to jet droplets of ink (non-jetting mode) at each jetting timing of each nozzle 30, based on printing data input from a PC 59 as a data input device which will be described later. The jetting timing of the nozzle 30 is a timing at which the recording paper P transported in the transporting direction and the ink jet head 3 which reciprocates in the scanning direction are in a predetermined positional relationship. When the ink is jetted at the appropriate jetting timing, it is possible to form the dots by making the droplets land at predetermined positions. The jetting timing is determined based on a transporting speed of the recording paper P and a scanning speed of the carriage 2.

Furthermore, one jetting mode among the seven types of jetting modes having different conditions such as a volume of droplets to be jetted (in other words, a size of a dot to be formed on the recording paper P) is selected for the nozzle 30 which jets the liquid droplets in order to realize a high quality image-printing by enabling multi-gradation representing. In other words, for each of the nozzles 30 in the ink jet head 3, an appropriate operation mode can be selected among the eight types of the operation modes of liquid jetting including the non-jetting mode in which the liquid droplets are not jetted, and the seven types of the jetting modes having different jetting conditions.

Concretely, firstly, data (selection data) for associating one of the eight types of the operation modes, namely the non jetting mode and the jetting mode of seven types, is transferred from an ASIC 54 (refer to FIG. 7) of the control unit 8 to the driver IC 47 at each jetting timing of each nozzle 30. The driver IC 47 generates a drive signal corresponding to the operation mode associated with that data, and supplies to the plurality of contact-point portions 45 (individual electrodes 42) of the actuator unit 7.

In FIGS. 6A to 6H, pulse waveforms (hereinafter, also called as 'driving waveforms') of the eight types of the driving signals which the driver IC 47 applies to the individual electrodes 42 of the actuator unit 7 are shown. In FIGS. 6A to 6H, the eight types of the driving waveforms namely, a non-jetting, extremely small droplets, first small droplets, first medium droplets, first large droplets, second small droplets, second medium droplets, and second large droplets are shown. Moreover, the driver IC 47 applies one of these eight types of the driving signals to the individual electrodes 42 of the actuator unit 7 corresponding to the nozzles 30.

Figure 6A:
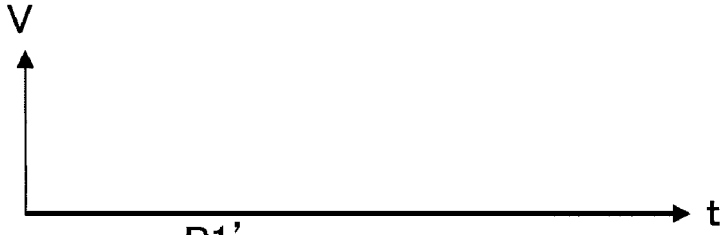
FIGS. 6A to 6H are diagrams showing pulse waveforms of a driving signal which is applied from the driver IC to the actuator unit, where.
Figure 6B:
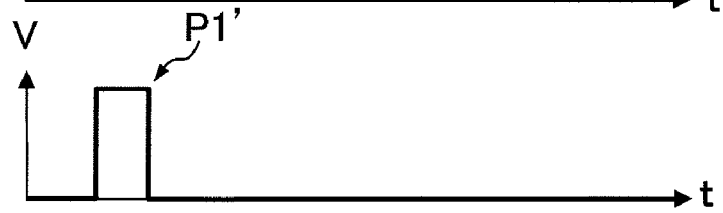
Figure 6C:
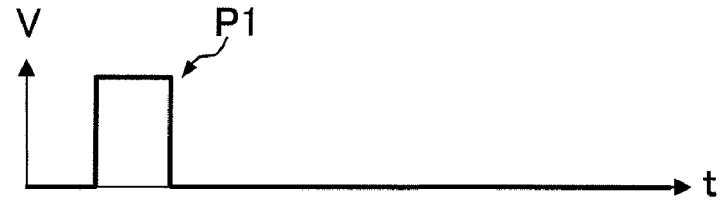
Figure 6D:
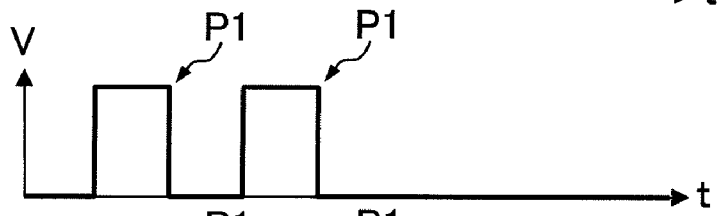
Figure 6E:
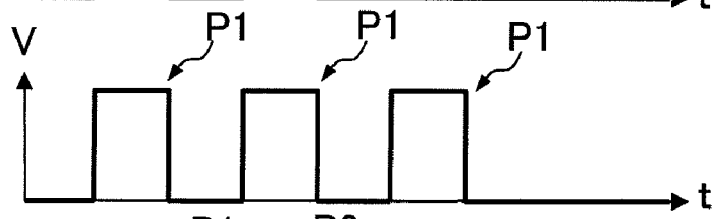

As shown in FIG. 6A, the driving signal corresponding to a mode in which liquid droplets are not jetted (non-jetting mode) is a signal of a constant voltage (ground electric potential) not having a jetting pulse. Moreover, each of the driving waveforms of the extremely small droplets, the first small droplets, and the second small droplets includes one jetting pulse P1' or P1 for jetting the liquid droplets (see FIGS. 6B, 6C, and 6F). The jetting pulse P1' for the extremely small droplets has a pulse width shorter than that of the jetting pulse P1 for the first/second small droplets, and pressure to be applied to ink in the pressure chamber 24 for jetting the extremely small droplets is smaller as compared to pressure to be applied for jetting the first/second small droplets. Moreover, the driving waveforms for the first medium droplets and the second medium droplets include two jetting pulses P1 (FIG. 6D and FIG. 6G). Furthermore, the driving waveforms for the first large droplets and the second large droplets include three jetting pulses P1 (FIG. 6E and FIG. 6H). Moreover, larger the number of jetting pulses P1, higher is a pressure to be applied to the ink by superimposing the pressure wave in the pressure chamber 24, and large liquid droplets are jetted from the nozzle 30. Accordingly, a magnitude correlation of the volume of the liquid droplets jetted from the nozzle 30 is extremely small droplets<small droplets<medium droplets<large droplets.

Figure 6F:
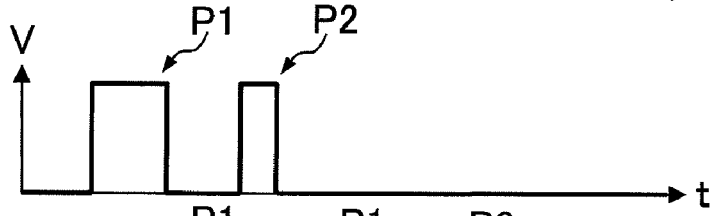
Figure 6G:
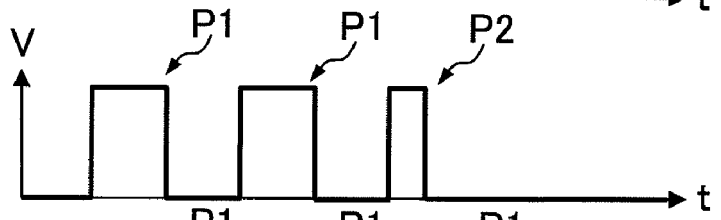
Figure 6H:
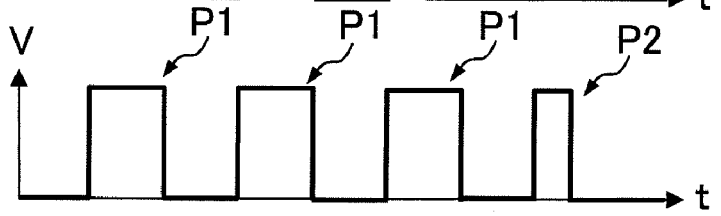

Furthermore, as shown in FIGS. 6F to 6H, in the driving waveforms of the second small droplets, second medium droplets, and the second large droplets, a cancel pulse P2 having a pulse width smaller than the jetting pulse P1 is applied after the last jetting pulse P1 (second jetting mode). The cancel pulse P2 is applied to suppress a fluctuation of pressure in ink developed due to the application of the jetting pulse P1 so as to reduce an effect caused by a remaining pressure wave at the subsequent jetting timing. For instance, the second small droplets, the second medium droplets, and the second large droplets are selected rather than the first small/medium/large droplets, when the liquid droplets of the subsequent jetting timing are extremely small droplets or small droplets, which are susceptible to the remaining pressure wave of the previous jetting timing. Whereas, when the liquid droplets of the subsequent jetting timing are small droplets and large droplets for example, and when there is hardly an effect of the remaining pressure wave of the previous jetting timing, the first jetting mode is selected. As shown in FIGS. 6B to 6E, in the first jetting mode, only the jetting pulse of the extremely small droplets, the small droplets, the medium droplets, and the large droplets is applied, and the cancel pulse is not applied.

Next, an electrical structure of the printer 1 will be described below. The description will be made by referring to block diagrams in FIGS. 5 7. As shown in FIG. 5, the flexible printed circuit (FPC) 48 is connected to the control unit 8. Moreover, the driver IC 47 of the ink jet head 3 is mounted on the FPC 48. The control unit 8 and the driver IC 47, and the driver IC 47 and the actuator unit 7 are connected electrically via a plurality of wires formed in the FPC 48.

Figure 7:
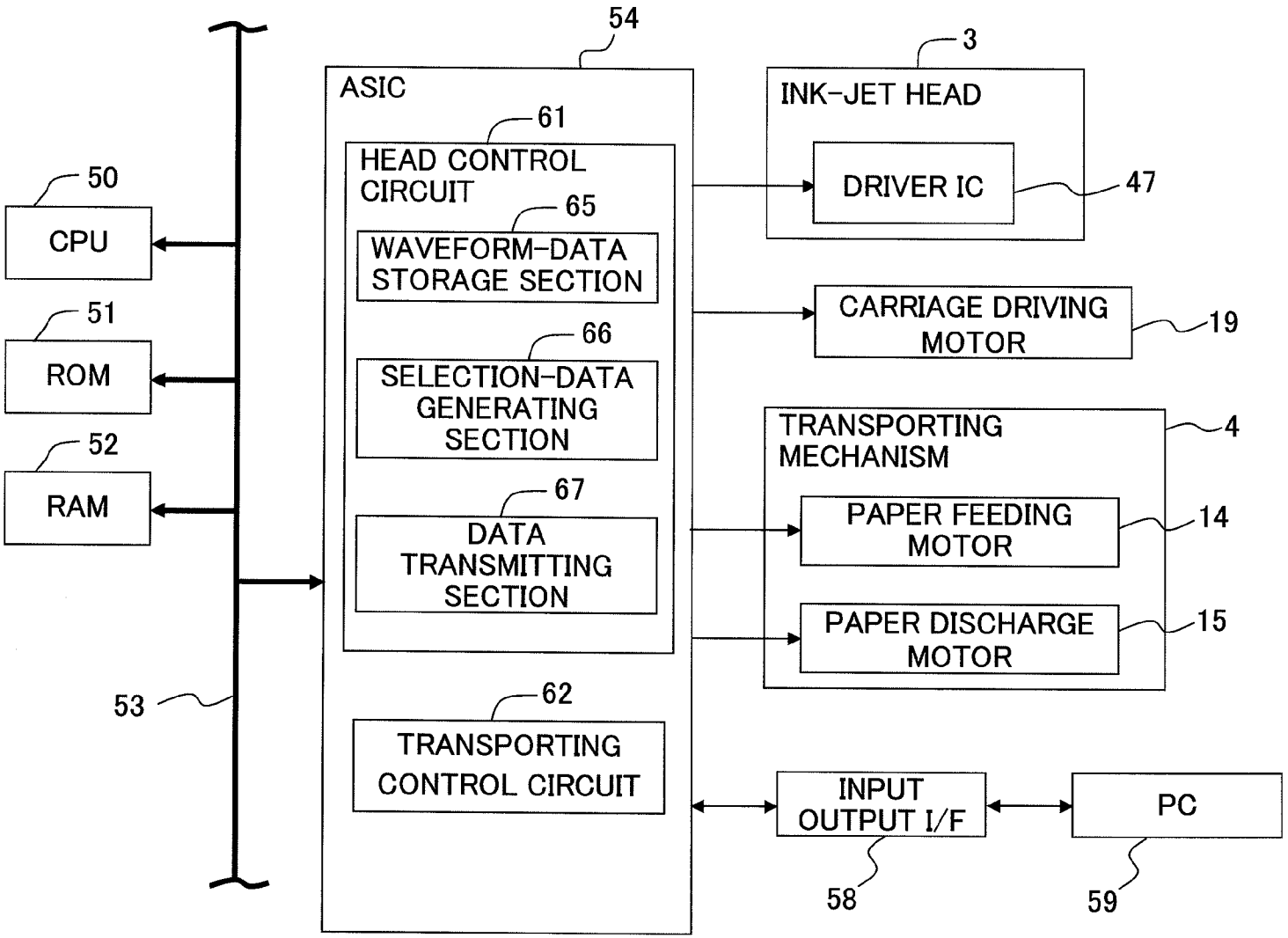
FIG. 7 is a block diagram showing an electrical structure of the printer.

As shown in FIG. 7, the control unit 8 includes a microcomputer which is made of a central processing unit (CPU) 50, a Read Only Memory (ROM) 51, a Random Access Memory (RAM) 52, and a bus 53 which connects the CPU 50, the ROM 51, and the RAM 52. Moreover, the driver IC 47 of the ink-jet head 3, and the Application Specific Integrated Circuit (ASIC) 54 which controls the carriage driving motor 19 which drives the carriage 2, the paper feeding motor 14 and the paper discharge motor 15 of the transporting mechanism 4 are connected to the bus 53. The ASIC 54 is data-communicably connected to the personal computer (PC) 59 which is an external device, via an input-output interface (I/F) 58.

A head control circuit 61 which controls each of the carriage driving motor 19 and the driver IC 47 of the ink-jet head 3 based on printing data input from the PC 59, and a transporting control circuit 62 which controls each of the paper feeding motor 14 and the paper discharge motor 15 of the transporting mechanism 4, based on the same printing data, are incorporated in the ASIC 54.

Next, the head control circuit 61 will be described below concretely. As shown in FIG. 7, the head control circuit 61 includes a waveform-data storage section 65, a selection-data generating section 66 (a selection-data generating mechanism), and a data transmitting section 67 (data transmitting mechanism).

The waveform-data storage section 65 stores data (waveform-data) related to the seven types of the driving waveforms associated with the seven types of the jetting modes (the extremely small droplets, the first small droplets, the second small droplets, the first medium droplets, the second medium droplets, the first large droplets, and the second large droplets) excluding the non-jetting mode. As shown in FIG. 6A, the driving signal of the non jetting mode is a signal of a constant voltage (ground electric potential). Therefore, it is not necessary to store a waveform (such as a pulse width and an interval between the pulses) of the non jetting mode in particular.

The selection-data generating section 66 generates the eight types of the selection data corresponding to the eight types of the driving waveforms as shown in FIGS. 6A to 6H, for determining as to which of the eight types of driving waveforms is to be selected for each jetting timing of each nozzle 30. Moreover, in order to make it possible to distinguish the eight types of the operation modes, each selection data is expressed by a combination of three bits data (total eight combinations) (refer to FIG. 8).

The data transmitting section 67 outputs various signals including the seven types of the waveform data stored in the waveform-data storage section 65 and the selection data generated by the selection-data generating section 66 to the driver IC 47 via wires (signal wires) of the FPC 48. More elaborately, as shown in FIG. 5, the data transmitting section 67 transmits each of the seven types of the waveform data to the driver IC 47 by using seven signal wires (wires from FIRE 1 to FIRE 7). Moreover, the data transmitting section 67 outputs serially the selection data (bit data of three bits: FIG. 8) selected for each nozzle 30, to the driver IC 47 upon synchronizing with a clock (CLK) by using three signal wires (wires from SIN_0 to SIN_2).

Furthermore, a serial transfer of data by the data transmitting section 67 will be described below with reference to FIGS. 9A and 9B. FIGS. 9A and 9B are an example of a case in which the number of nozzles (channels) is 332, and x=0~331. 'OUT x' for each of the signal wires (SIN_0 to SIN_2) in FIGS. 9A and 9B indicates that the selection data corresponding to the "x-th" nozzle 30 ("x-th" channel) is to be transferred, and n (=2, 1, 0) which is next to OUT x indicates that selection data of three bits is to be transferred in order of the most significant bit, an average significant bit, and the least significant bit. For instance, regarding the signal wire SIN_0, selection data of three bits corresponding to 125th nozzle 30 (125th channel) is transferred in order upon synchronizing with a first transfer clock to a third transfer clock.

A shown in FIGS. 9A and 9B, selection data corresponding to the nozzles 30 from the 0th nozzle to the 125th nozzle is transferred by the wire SIN_0, selection data corresponding to the nozzles 30 from the 126th nozzle to the 251st nozzle is transferred by the wire SIN_1, and selection data corresponding to the nozzles 30 from the 252nd nozzle to the 331st nozzle is transferred by the wire SIN_2.

Furthermore, the data transferring section 67 transfers continuously seven bits of a signal of Hi (bit '1') next to a tail end of the last selection data (the selection data corresponding to the 252nd nozzle 30) transferred by the wire SIN_2. These seven bits are bits for generating, in the driver IC 47, a control signal (a strobe signal (STB) which will be described later) which controls the driver IC 47. In this manner, the signal of seven bits for generating the strobe signal in the driver IC 47 is transferred to the driver IC 47 by the signal wire (SIN_2) for transmitting the selection data. Therefore, a signal wire exclusively for transferring the signal of seven bits is not necessary. In this case, since the strobe signal is generated in the driver IC 47, that is, the strobe signal is not transferred through a signal wire, there is no fear that unexpected strobe signal caused by the noise in the signal wire occurs. As shown in FIG. 9B, when the total length of data transferred by the wire SIN_2 is shorter than that transferred by the other wires SIN_0,1, a signal of Low (bit '0') is inserted to fill an interval between the last selection data (252) transferred by the wire SIN_2 and the data of seven bits at the tail end, in order to make up the total length of data transferred by the wires SIN_0,1,2.

Incidentally, all the seven bits to be transferred last by the signal wire SIN_2 are bit '1', and all the bits of the selection data ('111') corresponding to the second large droplets are also bit '1' as shown in FIG. 6H. In other words, a combination of bit data same as the selection data corresponding to the second large droplets is also used for generating the strobe signal in the driver IC 47. Therefore, seven or more of bit '1' may be continued not only at the tail end of the selection data (when the transfer of the selection data is over), but also during the transfer of the selection data. For instance, when three or more selection data of '111' corresponding to the second large droplets has been transferred, seven or more of bits '1' are continued. Even though seven or more of bits '1' are transferred continuously, it is necessary to distinguish, in the driver IC 47, whether the selection data corresponding to the second large droplet has been sent continuously or it is a data transfer for generating the strobe signal.

Therefore, in the embodiment, the data transmitting section 67 outputs serially the data to the driver IC 47 upon inserting dummy data (insertion data) having a combination of bit data differing from the selection data for generating the strobe signal, as indicated by 'Dummy' in FIG. 9, between the plurality of selection data associated with the plurality of nozzles 30, which is to be transferred continuously. Concretely, '000' same as the selection data corresponding to the non-jetting mode is used as the dummy data differing from the selection data '111' for generating the strobe signal, and regarding the transfer by the signal wire SIN_2, the dummy data of three bits '000' is inserted for every two pieces of selection data. In other words, as shown in FIGS. 9A and 9B, the dummy data is transferred after the two peaces of selection data corresponding to the 331st nozzle 30 and the 330th nozzle 30 have been transferred. Moreover, the dummy data is transferred after the two pieces of the selection data corresponding to the 329th nozzle 30 and the 328th nozzle 30 have been transferred. This procedure is repeated till transferring the selection data corresponding to the last 252nd nozzle 30.

Accordingly, even when the two selection data to be transferred continuously are bit data of '111' corresponding to the second large droplets, data of '000' is to be transferred subsequently. Consequently, the bit data to be transferred is . . . '000 (dummy)'→'111 (second large droplets)'→'111 (second large droplets)'→'000 (dummy)', and the number of bits '1' to be continued is at the most six, and seven or more of the bits '1' are not continued. In other words, seven bits '1' are transferred only for data of seven bits which follows at the tail end of the last selection data.

The number n3 (here, n3=7) of bit data '1' which is to follow at the tail end of the selection data is determined as follows. Letting the number of bits of the selection data to be n1 (here, n1=3), when the data transmitting section 67 has made an attempt to insert the dummy data for every two (here, n2=2) pieces of selection data, the maximum number of the selection data formed only by the bit '1' to be transferred continuously are n2. In other words, the maximum number of continuous bits '1' is n1×n2. Consequently, the number n3 of the bit data '1' to be followed at the tail end of the selection data is to be at least "n1×n2+1", in order to distinguish whether the selection data formed only by the bit '1' is transferred continuously, or the bit '1' is transferred continuously for generating the strobe signal. Furthermore, from a view point of making short a transfer time by reducing the number of overall data transfers, it is preferable to let the number n3 of the bit data '1' to be the minimum number thereof (n3=n1×n2+1).

Next, the driver IC 47 which drives the actuator unit 7 of the ink-jet head 3 based on the signal transmitted from the data transmitting section 67 of the head control circuit 61 will be described below in detail.

The driver IC 47 determines the driving waveform by selecting an operation mode of one type from among the eight types of the operation modes in FIG. 6, based on the selection data which has been output serially for each nozzle 30. Furthermore, the driver IC 47 generates a driving signal of a predetermined voltage by amplifying a signal having this driving waveform (refer to FIG. 5), and supplies the driving signal of the predetermined voltage to the actuator unit 7 (more concretely, to the individual electrode 42 corresponding to each nozzle 30).

Figure 10:
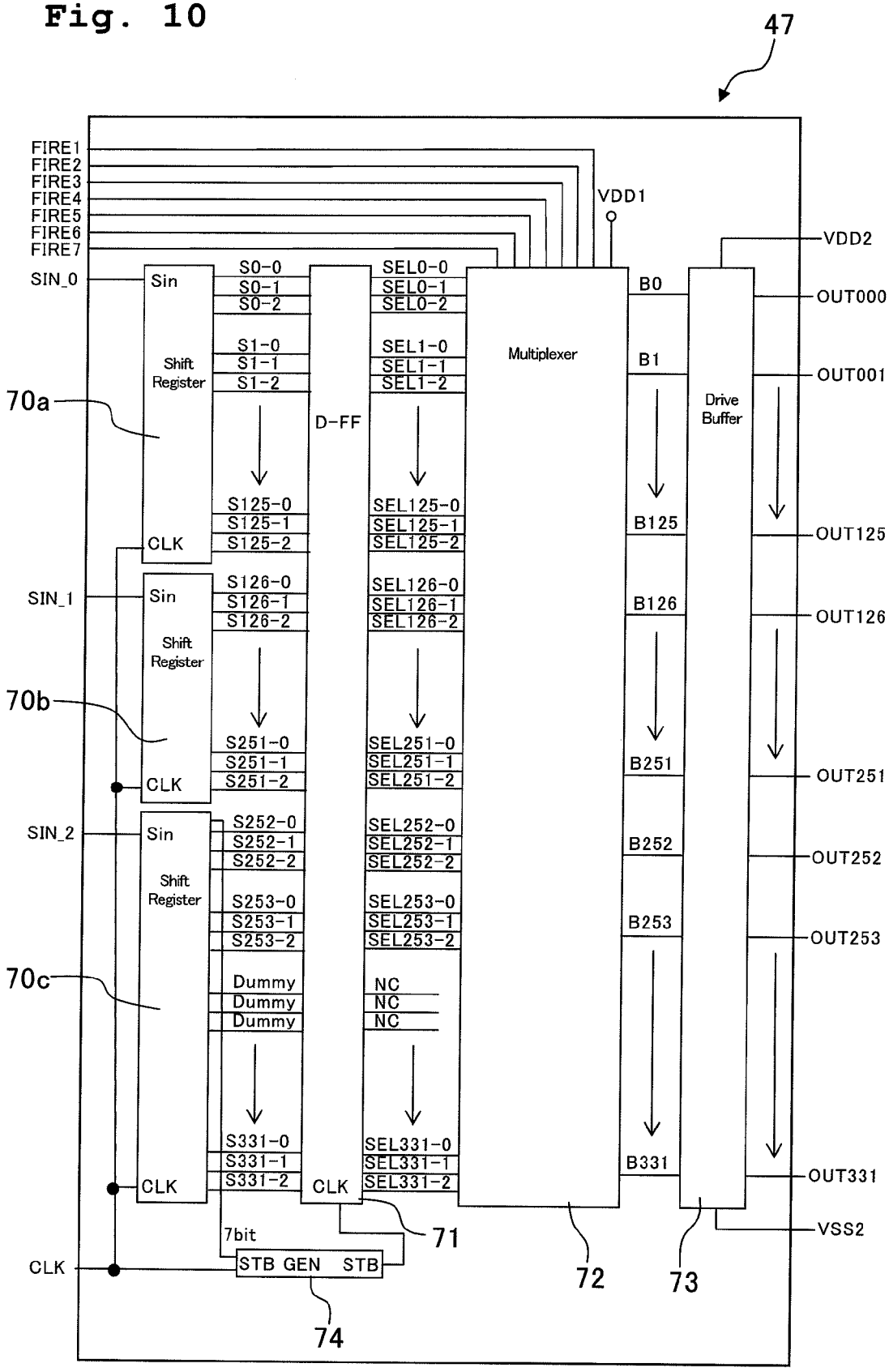
FIG. 10 is a circuit diagram of the driver IC.

As shown in FIG. 10, the driver IC 47 includes three shift registers 70*a*, 70*b*, and 70*c* (serial-parallel converters) which convert to parallel, the selection data which has been input serially from the data transmitting section 67 of the control unit 8, D flip-flop 71 (a latching circuit) which holds the selection data which has been output in parallel from the shift registers 70*a* to 70*c*, a strobe-signal generating circuit 74 (a control signal generator) which generates the strobe signal (STB) for outputting the selection data held in the D flip-flop 71, a multiplexer 72 (waveform selector circuit) which selects the driving waveform from the selection data which has been output from the D flip-flop 71, and a drive buffer 73 which generates the driving signal by amplifying the driving waveform.

The selection data which has been transmitted from the three signal wires (SIN_0~SIN_2) respectively from the data transmitting section 67 is synchronized with a transfer clock and is input serially to the three shift registers 70*a* to 70*c*. Moreover, the three shift registers 70*a* to 70*c* convert the selection data input serially to parallel, and outputs parallel signals Sx-0, Sx-1, Sx-2 (where, x=0~331) to the D flip-flop 71.

As shown in FIGS. 9A, 9B and 10, not only the selection data of three bits but also the dummy data ('Dummy') of three bits which has been inserted between the selection data, and the data of seven bits of Hi ('1') which is attached to the tail end of the last selection data are input serially to the shift register 70*c* connected to the signal wire SIN_2. Moreover, the shift register 70*c* converts the dummy data of three bits to parallel same as the selection data, and outputs to the D flip-flop 71. Whereas, the data of seven bits attached at the tail end of the selection data is output to the strobe-signal generating circuit 74 which will be described later.

The D flip-flop 71 holds temporarily the selection data which has been input in parallel (parallel signals Sx-0, Sx-1, and Sx-2) from the three shift registers 70*a* to 70*c* till the completion of the entire selection data. Next, when the input of the selection data is completed, the strobe signal (STB) is input from the strobe-signal generating circuit 74 which will be described later, and the D flip-flop 71 outputs in parallel, the selection data being held to the multiplexer 72 (SELx-0, SELx-1, and SELx-2). As shown in FIG. 10, the dummy data which has been input from the shift registers 70*a* to 70*c* is not input to the multiplexer 72 (indicated as 'NC' in the diagram). In other words, only the selection data corresponding to all the nozzles 30 is input from the multiplexer 72. The dummy data is not used in the multiplexer 72, and has no effect at all on the waveform selection in the multiplexer 72.

The strobe-signal generating circuit 74 generates the strobe signal (STB) when seven bits of the bit data '1' is input continuously through the signal wire SIN_2 via the shift register 70*c*, and outputs the strobe signal to the D flip-flop 71. Here, as it has been described above, in the serial input from the data transmitting section 67 through the signal wire SIN_2, the dummy data ('000') of three bits is inserted for every two pieces of the selection data. Therefore, even when the selection data ('111') corresponding to the second large droplets is transmitted continuously for three times or more, seven or more than seven bits of the bit data 1' are not transferred continuously during the transfer of the selection data. In other words, seven bits of the bit data '1' is input to the strobe-signal generating circuit 74 only when input continuously at the tail end of the selection data from the SIN_2. Consequently, no strobe signal is output from the strobe-signal generating circuit 74, to the D flip-flop during the transfer of the selection data.

The seven types of the waveform data (FIRE 1~FIRE 7) corresponding to the seven types of the jetting modes respectively as shown in FIGS. 6B to 6H are input to the multiplexer 72 and also a ground signal (VDD 1) is input to the multiplexer 72. Moreover, as shown in FIG. 8, the multiplexer 72 selects one waveform from among the driver waveforms of the eight types of the operation modes including the non jetting mode (FIG. 6A), based on the selection data (SELx-0, SELx-1, and SELx-2) of three bits which has been input from the D flip-flop, and outputs that selected waveform signal Bx to the drive buffer 73.

The drive buffer 73 amplifies the waveform signal Bx which has been input from the multiplexer 72, and generates a driving signal OUTx of a predetermined voltage (VDD 2). The drive buffer 73 further supplies the driving signal OUTx to the individual electrode 42 of the actuator unit corresponding to that nozzle 30 (channel).

In this manner, in the embodiment, the combination ('111') of the bit data in which '1' is continuous, is used for generating the strobe signal, and is also used as the selection data. Therefore, it is possible to increase the types of the operation modes which can be selected, without increasing the number of bits of the selection data from three bits to four bits. In this case, it is also possible to make short the transfer time of the selection data. Further, since there is no need to handle four-bit selection data in the driver IC 47, it avoids the driver IC 47 from being complicated.

In the followings, changes in the number of transfer data in two cases are discussed. In the first case, the selection data is three bits as suggested in the present teachings, and in the second case, the selection data is increased to four bits. Results are shown in FIGS. 11A to 13B. FIGS. 11A, 12A, and 13A indicate cases when the selection data is three bit, and FIGS. 11B, 12B, and 13B indicate cases when the selection data is four bit. When the selection data is four bit, the combinations of the bit data are increased to 16. Therefore, it is not necessary to use a combination '1111' of the bit data in which '1' is continuous, as selection data, and it is used only for generating the strobe signal.

FIGS. 11A and 11B are examples in which a comparison is made with extremely simple conditions namely, the serial input is by only one signal wire (SIN_2), and the selection data to be transferred are two (in other words, two nozzles 30 (channels)). In these examples, when the number of bits of the selection data is three, it is necessary to input seven bits of Hi ('1') continuously for generating the strobe signal. Therefore, the number of transfer data as a whole increases than in a case of four bits. This is limited to a condition which is almost impossible in a real ink jet head that, the number of nozzles is two. Moreover, when the number of such transfer data is extremely small, a length of transfer time is originally so short that it doesn't cause a problem. Although the number of data increases to a certain extent and the transfer time becomes long, there is no difficulty whatsoever.

FIGS. 12A and 12B are examples in which a comparison is made with conditions namely, the serial input is by two signal wires (SIN_0 and SIN_2), and the number of selection data to be transferred is two. In these examples, the number of selection data has increased to be more than in the examples of FIGS. 11A and 11B. A fact that the number of bits of each selection data is small becomes advantageous, and the number of transfer data of the embodiment becomes smaller than in a case of four bits.

Furthermore, FIGS. 13A and 13B are examples in which a comparison is made with a condition that the number of selection data to be transferred is 12. In these examples, the number of selection data has further increased. Therefore, the fact that the number of bits of each selection data of the embodiment is small becomes even more advantageous. When the selection data to be transferred by one signal line (SIN_2) increases, the data to be transferred increases by the dummy data of three bits which is inserted for every two pieces of the selection data. However, even considering this, the overall number of transfer data has becomes small as compared to a case of four bits. In this manner, larger the number of selection data to be transferred (the number of nozzles 30 (channels)), smaller is the number of transfer data as compared to the case in which the selection data is formed by four bits, and it is clear that this is advantageous from a point of transfer time.

According to the ink-jet printer 1 described above, the data transmitting section 67 of the control unit 8 in the body of the printer 1, further transmits continuously seven bits of the bit data of Hi ('1') after outputting serially the selection data for selecting the operation mode of each nozzle 30 from among the eight types of the operation modes, to the driver IC 47. Moreover, when the data of seven bits has been input continuously, the strobe-signal generating circuit 74 in the driver IC 47 generates the strobe signal for operating the D flip-flop 71. In this manner, since the strobe signal is generated in the driver IC 47, a signal wire for inputting the strobe signal from the control unit 8 to the driver IC 47 is not necessary.

Moreover, the data transmitting section 67 inserts the dummy data '000' of three bits different from the data to be used for generating the strobe signal, between the selection data, at the time of outputting serially the selection data corresponding to the nozzles 30 to the driver IC 47. Accordingly, even though it is a case in which the selection data '111' is transferred continuously under ordinary circumstances, the dummy data is inserted between those selection data. Therefore, no predetermined number (seven bits) or more of bit '1' is continued, and it is possible to prevent from being distinguished mistakenly as data for generating the strobe signal.

Accordingly, it is possible to use the combination of bit data of one type for both, the selection data for waveform selection and the data for generating the strobe signal. In other words, since it is possible to use the combination of three bits which has hitherto been assigned (allocated) exclusively for generating the strobe signal, as the selection data, it is possible to increase the types of operation modes without increasing the number of bits of the selection data. Consequently, the circuit structure of the driver IC 47 does not become complicated, and moreover, it is advantageous from an aspect of transfer time of the selection data.

Next, modified embodiments in which various modifications are made in the embodiment will be described below. However, same reference numerals are assigned to components having a similar structure as in the embodiment, and the description of such components is omitted appropriately.

In the embodiment, the data transmitting section 67 inserts dummy data for every two pieces of the selection data at the time of transmitting the selection data to the driver IC 47 (refer to FIG. 9). However, dummy data may be inserted for every one piece of the selection data, that is, the selection data and the dummy data may be transmitted alternately. Moreover, dummy data may be inserted for every three or more pieces of selection data according to a length of a bit pattern which is to be used as data for generating the strobe signal.

It is not necessary that the dummy data to be inserted between the selection data is a selection data corresponding to the non jetting mode ('000' in the embodiment), and another selection data, other than the selection data which is to be transferred continuously for generating the strobe signal ('111' in the embodiment), may be used. Here, a case of inserting at least one piece of dummy data for every n2 number of selection data is taken into consideration. In this case, when the n2 number of selection data and at least one dummy data which is to be inserted thereafter are let to be one data block, a plurality of data blocks are transmitted continuously. As long as a bit pattern of a predetermined number of bit data, which is to be transferred continuously for generating the strobe signal is not included in the bit pattern of the continuously transferred data blocks, the dummy data and the bit data for generating the strobe signal may be determined arbitrarily. In other words, no matter how the selection data has been selected, the dummy data and the data for generating the strobe signal can be selected such that the bit pattern of the data for generating the strobe signal never appear in the continuously transferred data blocks.

It is possible to change the number of bits of the selection data appropriately according to the number of operation modes. For example, when the selection data is two bits, it is possible to select the operation modes of four types, and moreover, when the selection data is four bits, it is possible to select the operation modes of 16 types.

A control signal which is generated in the driver IC 47, when a predetermined number of bit data which is transmitted continuously at the tail end of the selection data from the data transmitting section 67 has been input to the driver IC 47, is not restricted to the strobe signal for operating the D flip-flop 71 (the latching circuit). Various types of the control signal which controls circuits other than the D flip-flop 71 are available. Moreover, the control signal may be a signal which controls a circuit that detects an operation state of the driver IC 47. For instance, when the driver IC 47 has a circuit that detects that the transfer of data such as the selection data has been completed, and when a predetermined number of bit data has been input, the detecting circuit may be structured to generate a data-transfer completion signal as the control signal, and output the data-transfer completion signal to the control unit 8.

The embodiment and the modified embodiments thereof described above, are just examples in which the present teachings are applied to an ink-jet printer which includes an ink-jet head. However, the present teachings are also applicable to a general recording apparatus (printer) of other recording type, such as a thermal printer.

What is claimed is:

1. A recording apparatus which performs recording on a medium, comprising:

a recording head having a plurality of recording elements each of which operates in a plurality of operation modes;

a drive unit which drives the recording elements;

a selection-data generating mechanism which generates a plurality of types of selection data, each of the selection data including a plurality of bit data, and being associated with one of the recording elements for selecting an operation mode, among the operation modes, of the one of the recording elements;

a data transmitting mechanism which outputs serially the selection data generated in the selection-data generating mechanism to the drive unit, and also outputs certain bit data which forms one type of the selection data at a tail end of the serially outputted selection data to the drive unit, the certain bit data including a predetermined number of bits larger than the number of bits of the selection data; and a control-signal generating mechanism which generates a control signal which controls the drive unit, under a condition that the bit data having the predetermined number of bits is inputted to the drive unit from the data transmitting mechanism, wherein the data transmitting mechanism inserts insertion data which is different from the one type of the selection data between the selection data associated with the recording elements, and outputs the selection data and the insertion data to the drive unit.

2. The recording apparatus according to claim 1, wherein each of the one type of the selection data and the insertion data is formed by a plurality of bit data having a same bit-value, and the bit-value of the one type of the selection data is different from the bit-value of the insertion data, and under a condition that the number of bits of each of the selection data is n1, and that the data transmitting mechanism inserts the insertion data every n2 number of the selection data, n1 and n2 being positive integers, the number of bits n3 which the data transmitting mechanism outputs continuously to the drive unit for generating the control signal satisfies an equation of $n3=n1\times n2+1$.

3. The recording apparatus according to claim 1, wherein the drive unit includes: a serial-parallel converter which converts, to a parallel signal, the selection data associated with the recording elements and inputted serially from the data transmitting mechanism; a latching circuit which temporarily holds the selection data outputted in parallel from the serial-parallel converter; and a waveform selector circuit which selects one driving waveform among a plurality of driving waveform based on the selection data outputted by the latching circuit, the driving waveforms being used for generating the operation modes of the recording elements, and the control signal generating mechanism generates a strobe signal, as the control signal, which is used for making the latching circuit output in parallel the selection data associated with the recording elements to the waveform selector circuit.

4. The recording apparatus according to claim 3, wherein the insertion data, inputted to the serial-parallel converter from the data transmitting mechanism, is not inputted to the waveform selector circuit.

5. The recording apparatus according to claim 1, wherein the one type of the selection data is formed only of continuous bit data of "1", and the insertion data is formed only of continuous bit data of "0".

6. The recording apparatus according to claim 1, wherein under a condition that the number of bits of each of the selection data is n1, both of the number of the selection data and the number of the operation modes are n1 power of 2.

7. The recording apparatus according to claim 1, wherein the recording apparatus is an ink-jet printer which jets ink droplets, and the operation modes include a non-jetting mode of not jetting the ink droplets from the recording elements.

8. The recording apparatus according to claim 7, wherein the operation modes further include four first jetting modes and three second jetting modes, the four first jetting modes having modes of jetting ink droplets of an extremely small size, a small size, a medium size, and a large size, and the three second jetting modes being modes of jetting ink droplets of a small size, a medium size, and a large size and thereafter, of canceling a remaining pressure wave of the ink of the recording element, and the number of bits of the selection data is three.

* * * * *